US008584615B2

(12) United States Patent
Stammen

(10) Patent No.: US 8,584,615 B2
(45) Date of Patent: Nov. 19, 2013

(54) MACHINE, AND SPRAY ASSEMBLY AND OSCILLATING SPRAY HEAD THEREFOR

(75) Inventor: Dennis C. Stammen, Vandalia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 177 days.

(21) Appl. No.: 13/114,506

(22) Filed: May 24, 2011

(65) Prior Publication Data

US 2012/0298772 A1 Nov. 29, 2012

(51) Int. Cl.
*B05B 3/00* (2006.01)
*B05B 13/06* (2006.01)

(52) U.S. Cl.
USPC ..... 118/323; 118/313; 118/315; 118/317; 118/306; 118/DIG. 3; 425/809

(58) Field of Classification Search
USPC ..... 118/323, 321, 313–315, 306, 317, 319, 118/320, DIG. 3, 318; 427/256, 284, 207.1, 427/208.4; 425/809; 239/243
See application file for complete search history.

(56) References Cited

U.S. PATENT DOCUMENTS 2,610,605 A 9/1952 Paasche
3,898,954 A * 8/1975 Galitz ..... 118/315
4,125,035 A 11/1978 Dooley
5,201,466 A 4/1993 Hynds
5,254,164 A 10/1993 Masahumi
6,547,878 B2 * 4/2003 Rutledge et al. ..... 118/52
6,730,168 B1 * 5/2004 Ross ..... 118/319

(Continued)

FOREIGN PATENT DOCUMENTS

CN 2048398 U 11/1989
CN 2719408 Y 8/2005

(Continued)

OTHER PUBLICATIONS

International Search Report and Written Opinion dated May 17, 2012.

*Primary Examiner* — Yewebdar Tadesse
(74) *Attorney, Agent, or Firm* — Eckert Seamans Cherin & Mellott, LLC; Grant E. Coffield

(57) ABSTRACT

A spray assembly includes a power source, a motion control mechanism such as a cam box, and at least one spray head structured to apply a coating to a plurality of can ends. Each spray head includes a mounting member, a pivot member, a gun assembly including a plurality of spray guns, and a transfer mechanism for transferring a predetermined motion induced by the cam box from the cam box to the pivot member. Each of the spray guns applies the coating to the can ends in accordance with the predetermined motion. Preferably the predetermined motion as an oscillating motion transferred to the pivot member by belts, thereby oscillating the spray guns. The spray assembly may include a plurality of spray heads, wherein can ends of the same or different sizes are transferred in lanes to a corresponding one of the spray heads.

9 Claims, 4 Drawing Sheets

(56) References Cited

U.S. PATENT DOCUMENTS

| | | | |
|---|---|---|---|
| 7,622,002 | B2 | 11/2009 | McEldowney et al. |
| 7,644,678 | B2 | 1/2010 | Carstens et al. |
| 7,691,431 | B2 | 4/2010 | Feng et al. |
| 7,861,945 | B2 | 1/2011 | Yasuda et al. |
| 2003/0010843 | A1 | 1/2003 | Liao |
| 2003/0203118 | A1 | 10/2003 | Wickes |
| 2005/0013930 | A1 | 1/2005 | Killmer, Sr. |
| 2007/0193509 | A1 | 8/2007 | Lawrynowicz et al. |
| 2007/0218196 | A1 | 9/2007 | McEldowney et al. |
| 2008/0277496 | A1 | 11/2008 | Yasuda et al. |
| 2010/0021629 | A1 | 1/2010 | McEldowney et al. |

FOREIGN PATENT DOCUMENTS

| | | | |
|---|---|---|---|
| CN | 201015754 | Y | 2/2008 |
| CN | 101342518 | A | 1/2009 |
| EP | 0967017 | A1 | 12/1999 |
| EP | 1634651 | A1 | 3/2006 |
| GB | 887340 | | 1/1962 |
| GB | 965753 | | 8/1964 |
| GB | 1200900 | | 8/1970 |
| JP | 11104533 | | 4/1999 |
| KR | 1020080073995 | | 8/2008 |
| WO | WO 03047767 | A1 | 6/2003 |

* cited by examiner

MACHINE, AND SPRAY ASSEMBLY AND OSCILLATING SPRAY HEAD THEREFOR

BACKGROUND

1. Field

The disclosed concept relates generally to machinery and, more particularly, to machines, such as for example, machines used to apply and/or repair coatings used on can ends in the food and beverage packaging industries. The disclosed concept further relates to spray assemblies and spray heads.

2. Background Information

Typically, can bodies for food or other products are provided with easy open can ends that are characterized by having a pull tab attached to the can end, which is used to fracture a tear panel on the can end defined by a score line on the can end. For example, the pull tab may be lifted to depress the tear panel in order to provide an opening in the can end for dispensing the contents of the container.

Likewise, many food products are sold in can bodies provided with full open easy open can ends that are characterized by having a pull tab attached to the can end, which is used to fracture a score line that circumscribes the circumference of the end panel to define an opening panel. For example, the pull tab may be lifted to fracture the score line. After the score line is fractured, the pull tab may be pulled upward from the container to sever the remainder of the score line in order to remove the entire opening panel for dispensing the contents of the container.

In the manufacture of an easy open can end, a pre-converted can end, commonly referred to as a shell, is conveyed to a conversion press. In the typical operation of a conversion press, the shell is introduced between upper and lower tool members, which are in the open, spaced apart position. A press ram advances the upper tool member toward the lower tool member in order to perform any of a variety of tooling operations such as rivet forming, paneling, scoring, embossing, and final staking After performing a tooling operation, the press ram retracts until the upper tool member and lower tool member are once again in the open, spaced apart position. The partially converted shell is then transported to the next successive tooling operation until an easy open can end is completely formed and discharged from the press. As one shell leaves a given tooling operation, another shell is introduced to the vacated operation, thus continuously repeating the entire easy open can end manufacturing process. Examples of easy open can ends can be found, for example, in U.S. Pat. Nos. 4,465,204 and 4,530,631. Conversion presses can operate at speeds that manufacture in excess of 500 can ends per minute per lane, with some presses having four lanes of tooling thereby manufacturing up to 2000 converted can ends, or more per minute.

Steel sheet stock used in the manufacture of can ends has a coating that protects the metal by inhibiting oxidation, corrosion or rust from forming on the surface of the metal. During the conversion process, damage to the protective coating typically occurs while forming the score line that defines the tear panel or opening panel of the can end. As noted above, in the conversion of a shell into a can end with openable features thereon, tooling is employed to form the aforementioned score line. The score line is the most likely location where damage is caused to the protective coating. Any oxidation, corrosion or rust on the surface of the can end that could result from such damage to the protective coating represents an unattractive product appearance to the consumer and is generally unacceptable to canmakers. Accordingly, as a precautionary measure to prevent oxidation, corrosion or rust from appearing on the can end, many canmakers apply a fluid, repair agent, lacquer or paint to coat the scored area of the can end by spraying the can end. This process is generally referred to as score repair or post repair.

The spray heads for known spraying apparatus and methods for score repair typically employ a single spray gun, which is rotated at relatively high speed (e.g., about 1000 rpm) in order to enable the spray gun to make one complete revolution around the can end during the spray portion of the machine cycle. Commonly assigned U.S. Pat. No. 7,622,002 discloses a spray machine, which employs a low-pressure solid stream spray head and method to reduce over spray or spray beyond the scored surface of the can end, and allow for improved machine efficiencies, for example, due to reduced downtime associated with routine cleaning and maintenance.

There is room for improvement in post repair machines, and in spray assemblies and spray heads therefor.

SUMMARY

These needs and others are met by embodiments of the disclosed concept, which are directed to a spray assembly for a post repair machine. Among other benefits, the spray assembly includes an oscillating spray head, which enables the efficient and effective application of a coating of fluid, repair agent, lacquer or paint to numerous can ends of varying sizes.

As one aspect of the disclosed concept, a spray head is provided for a spray assembly structured to apply a coating to a plurality of can ends. The spray assembly includes a power source and a motion control mechanism. The spray head comprises: a mounting member; a pivot member including a first end movably coupled to the mounting member, and a second end disposed opposite and distal from the first end; a gun assembly comprising a plurality of spray guns coupled to the pivot member proximate the second end; and a transfer mechanism structured to transfer a predetermined motion that is induced by the motion control mechanism from the motion control mechanism to the pivot member. Each of the spray guns is structured to apply the coating to a corresponding portion of each can end in accordance with the predetermined motion.

The pivot member may be a pivotal shaft, and the second end of the pivotal shaft may include a first mounting portion and a second mounting portion disposed opposite the first mounting portion. The plurality of spray guns may be a first spray gun coupled to the first mounting portion and a second spray gun coupled to the second mounting portion. The pivotal shaft may have a longitudinal axis of rotation, and the gun assembly may further comprise a number of spacers. Each of the spacers may be disposed between one of the first and second mounting portions and a corresponding one of the first and second spray guns, thereby offsetting the spray gun with respect to the longitudinal axis of rotation.

The predetermined motion may be an oscillating motion comprising the following sequential steps: (a) an acceleration of the spray guns in a first direction to begin a spray cycle; (b) rotation of the spray guns at a constant predetermined rotational velocity in the first direction as a first can end is sprayed; (c) deceleration of the spray guns in the first direction to a complete stop; (d) acceleration of the spray guns in a second, reverse direction; (e) rotation of the spray guns at a constant predetermined rotational velocity in the second direction as another second can end is sprayed; and (f) deceleration of the spray guns in the second direction to a complete stop, thereby ending the spray cycle.

The spray guns may rotate about a central axis. A first one of the spray guns may begin the spray cycle at 0 degrees with respect to the central axis. The spray gun may accelerate in the first direction from 0 degrees to about 45 degrees with respect to the central axis. From about 45 degrees to about 225 degrees the spray gun may rotate in the first direction at the constant predetermined rotational velocity. From about 225 degrees to about 270 degrees the spray gun may decelerate. The spray gun may stop at about 270 degrees. From about 270 degrees to about 225 degrees the spray gun may accelerate in the second, reverse direction. From about 225 degrees to about 45 degrees the spray gun may rotate in the second direction at the constant predetermined rotational velocity. From about 45 degrees to 0 degrees the spray gun may decelerate. The spray gun may stop at about 0 degrees to end the spray cycle.

The motion control mechanism may be a cam box. The cam box may include an input shaft, an output shaft, and a number of cams. The power source may be a motor, wherein the motor moves the input shaft, thereby moving the cams to induce the predetermined motion as an oscillating motion of the output shaft. The transfer mechanism may be a number of belts, wherein the belts transfer the oscillating motion to the pivot member, thereby oscillating the spray guns.

A spray assembly and a machine employing a number of the aforementioned spray heads, are also disclosed.

The spray assembly may include a plurality of spray heads. The machine may include a plurality of lanes each delivering a plurality of can ends to a corresponding one of the spray heads.

The plurality of spray heads may be a first spray head and a second spray head, the plurality of lanes may be a first lane and a second lane, and the plurality of can ends may include a first plurality of can ends being transported by the first lane to the first spray head, and a second plurality of can ends being transported by the second lane to the second spray head. The first plurality of can ends may have a first diameter, and the second plurality of can ends may have a second diameter different from the first diameter.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
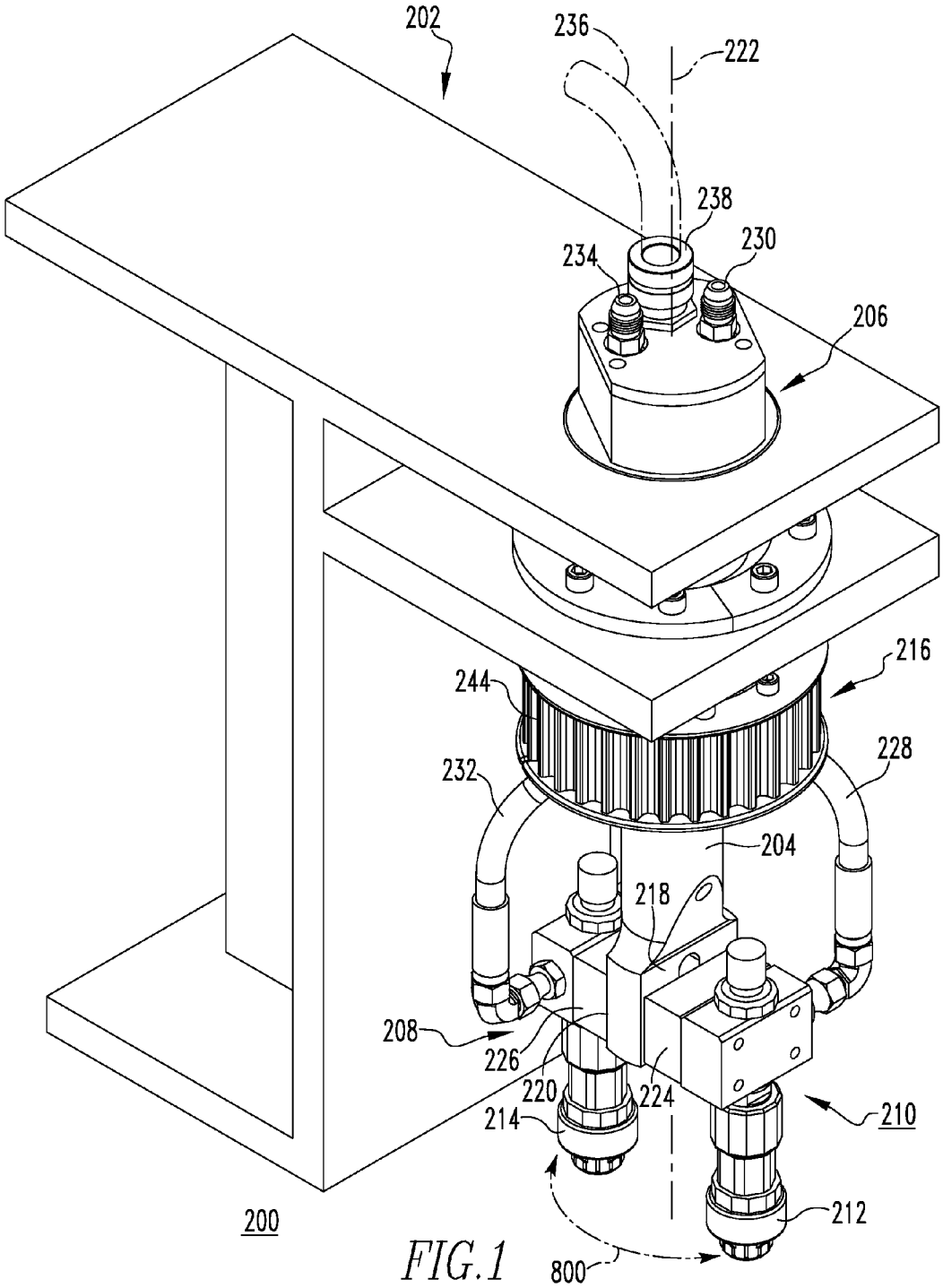
FIG. 1 is an isometric view of a spray head, in accordance with an embodiment of the disclosed concept.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As used herein, the term "pull tab" or "tab" refers to an opening device (e.g., opener) made from generally rigid material that has undergone one or more forming and/or tooling operations, and which is structured to be suitably affixed to a can end for the purpose of being pivoted to sever a score line and open at least a portion of the can end.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
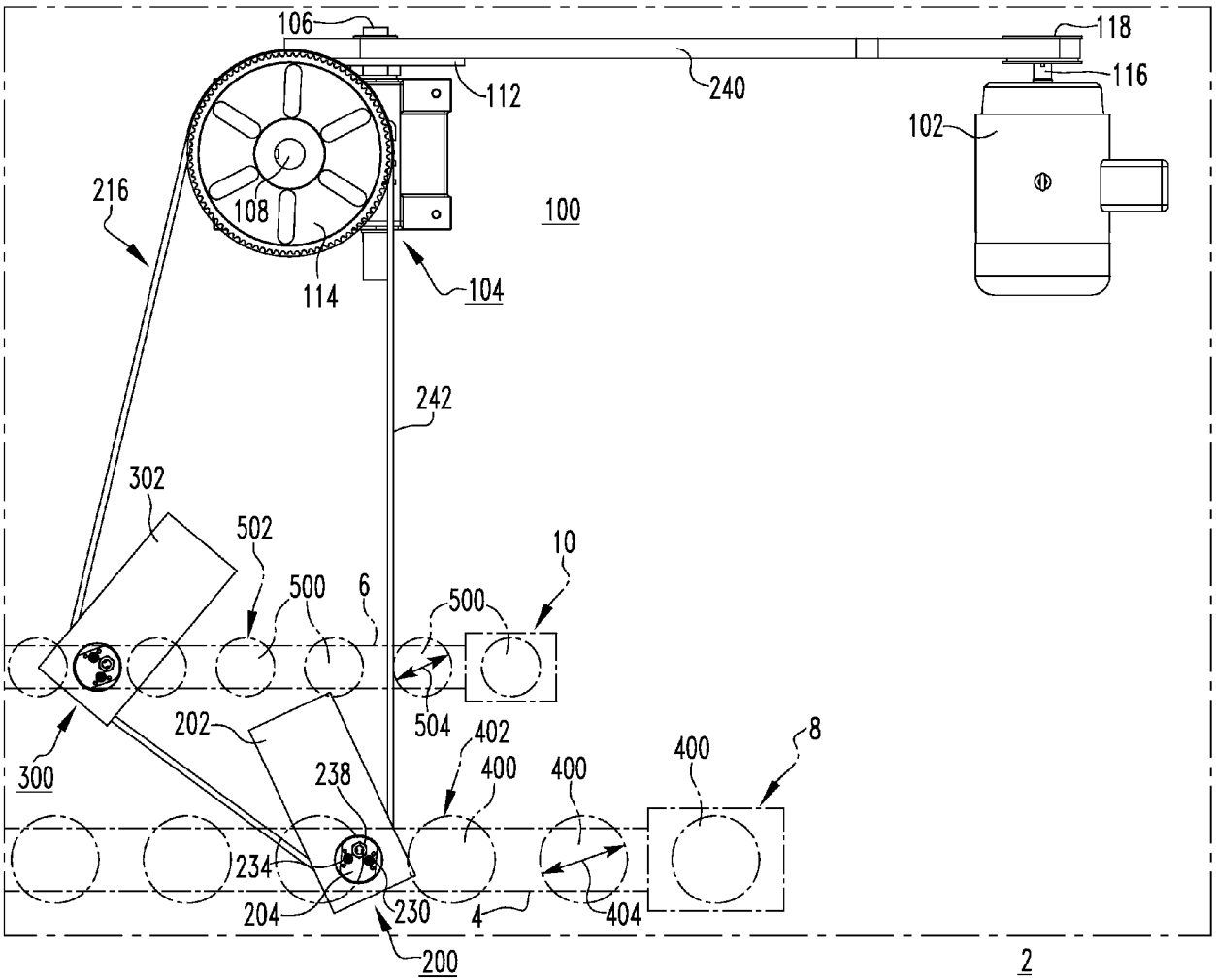
FIG. 2 is a top plan view of a machine and a spray assembly therefor having two spray heads, in accordance with an example embodiment of the disclosed concept.

FIG. 1 shows a spray head 200 for a spray assembly 100 (FIGS. 2 and 3) structured to apply a coating to a plurality of can ends (see, for example, can ends 400 and 500, shown in simplified form in phantom line drawing in FIG. 2). As will be described in greater detail hereinbelow, the spray assembly 100 includes a power source 102 and a motion control mechanism 104.

Each spray head 200 (see also spray head 300 of FIGS. 2 and 3) includes a mounting member 202 structured to mount the spray head 200 to a corresponding surface of a machine 2 (shown in simplified form in phantom line drawing in FIG. 2) (see also mounting member 302 for mounting spray head 300 to another corresponding surface of machine 2 of FIG. 2). Referring again to FIG. 1, the pivot member 204 includes a first end 206 movably coupled to the mounting member 202, and a second end 208 disposed opposite and distal from the first end 206. A gun assembly 210 includes a plurality of spray guns 212,214 coupled to the pivot member 204 proximate the second end 208. A transfer mechanism 216 (described in greater detail hereinbelow) is structured to transfer a predetermined motion that is induced by the motion control mechanism 104 (FIGS. 2 and 3) from the motion control mechanism 104 to the pivot member 204. Accordingly, each of the spray guns 212,214 is structured to apply the coating to a corresponding portion of each can end (see, for example and without limitation, can ends 400 of FIG. 2), in accordance with the predetermined motion.

Figure 4:
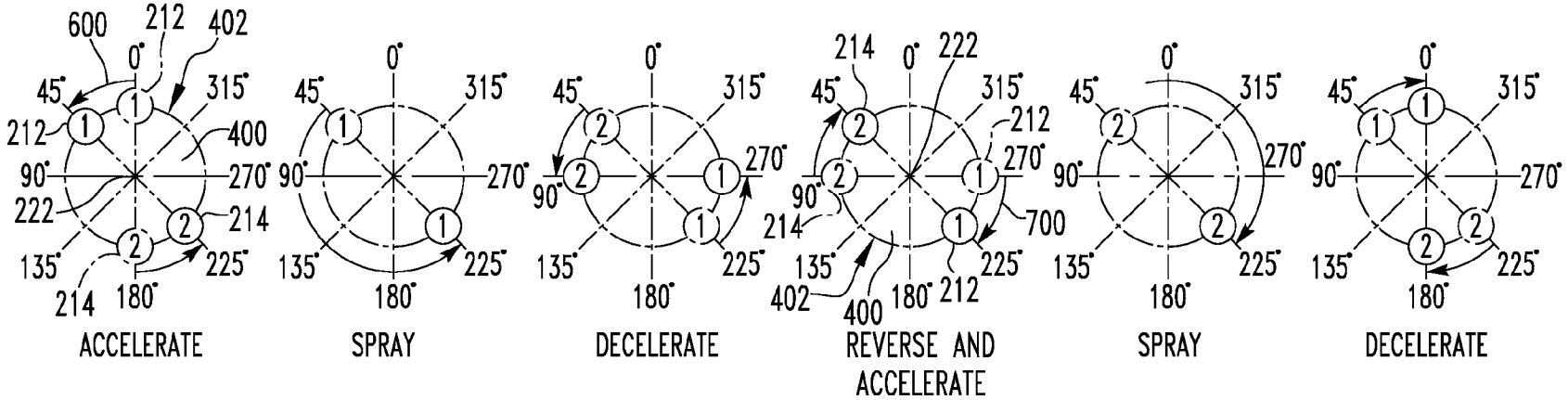
FIG. 4 is a simplified schematic view showing the spray head kinematics, in accordance with an embodiment of the disclosed concept.

In the example shown and described herein, the pivot member is a pivotal shaft 204, wherein the second end 208 of the pivotal shaft 204 includes first and second opposing mounting portions 218,220. A first spray gun 212 is coupled to the first mounting portion 218, and a second spray gun 214 is coupled to the second mounting portion 220, as best shown in FIG. 1. The pivotal shaft 204 has a longitudinal axis of rotation 222 (FIG. 1; see also FIG. 4). The gun assembly 210 preferably further includes a number of spacers 224,226, wherein each of the spacers 224,226 is disposed between one of the first and second mounting portions 218,220 and the corresponding one of the first and second spray guns 212,214, respectively, thereby offsetting the spray guns 212,214 with respect to the longitudinal axis of rotation 222, as shown. Accordingly, it will be appreciated that the spacers 224,226 function not only to provide a relatively quick and easy mechanism for accurately mounting the spray guns 212,214 to the mounting portions 218,220, respectively, but also serve to appropriately adjust the size of the arcuate spray path of the spray guns 212, 214 to correspond to the diameter (see, for example, diameter 4 of FIG. 2) of the can ends (see, for example, can ends 400 of 402). It will be appreciated, therefore, that the spray head 200 and, in particular, the spray guns 212,214 therefor, can be relatively quickly and easily adjusted to accommodate a wide variety of different can end diameters (see, for example and without limitation, smaller can diameter 504 of can end 500 of FIG. 2). Thus, it will further be appreciated that the spray assembly 100, in accordance with the disclosed concept, could employ a plurality of spray heads 200,300 each being structured to apply the coating to can ends 400,500 having different diameters 404,504, respectively, as shown in the non-limiting example embodiment of FIG. 2.

Referring again to FIG. 1, it will be appreciated that the example spray head 200 further includes a number of additional enhancements. For example and without limitation, the gun assembly 210 preferably includes a first supply line 228 having a first connector 230, a second supply line 232 having a second connector 234, and a single electrical conductor 236 (e.g., without limitation, electrical wire 236, partially shown in phantom line drawing in FIG. 1) having a single electrical connector 238. The first and second connectors 230,234 for the first and second supply lines 228,232, respectively, and the single electrical connector 238 for the electrical conductor 236, are advantageously all disposed on the first end 206 of the pivotal shaft 204, as shown. Among other benefits, this eliminates the need to use a rotary union or other rotating mechanical joint as well as the need for a rotary electrical joint, thereby substantially reducing the complexity of the design and significantly improving the ability to relatively quickly and easily modify it, for example and without limitation, to accommodate a wide variety of different spray gun configurations (not shown) for use in suitably coating (e.g., without limitation, repairing) a wide variety of different can end types and sizes. In addition, having all of the connections 230,234,238 at one location, (e.g., without limitation, first end 206 of pivotal shaft 204) provides for relatively easy and quick changeover of the spray head(s) 200,300 (both shown in FIGS. 2 and 3).

The predetermined motion of the spray head and, in particular, the spray guns 212,214 thereof, will be further appreciated with reference to the schematic illustration of FIG. 4. Specifically, the predetermined motion is preferably an oscillating motion (i.e., a back-and-forth motion in the clockwise and counterclockwise directions of arrow 800 from the perspective of FIG. 1) in accordance with the following sequential steps. Together, the following steps comprise a single spray cycle. Specifically, the motion begins with an acceleration of the spray guns 212,214 (also indicated respectively in FIG. 4 as spray guns "1" and "2") in a first direction (e.g., counterclockwise in the direction of arrow 600 from the perspective of FIG. 4) to begin the spray cycle. Following the acceleration, the spray guns 212,214 rotate at a constant predetermined rotational velocity in the first direction (e.g., counterclockwise) as a first can end 400 and, in particular, the score line 402 (both shown in simplified form in phantom line drawing in FIG. 2) is sprayed (e.g., without limitation, coated, repaired). The spray guns 212,214 then decelerate in the first direction to a complete stop. Next, the spray gun 212,214 begin to move and accelerate in a second, reverse direction (e.g., clockwise in the direction of arrow 700 from the perspective of FIG. 4). As this is occurring, the can ends 400 are transferred so that the next successive can end 400 is exposed to the spray head 200. After the acceleration in the second direction (e.g., clockwise), the spray guns 212,214 rotate at a constant predetermined rotational velocity in the second direction as the next successive can end 400 is sprayed. Finally, the spray guns 212,214 decelerate in the second direction to a complete stop, thereby ending the spray cycle in connection with the can end 400.

It will be appreciated that the foregoing spray cycle may repeat such that the spray guns 212,214 oscillate back-and-forth as the can ends 400 are coated or repaired. In one non-limiting embodiment the spray guns 212,214 oscillate back-and-forth up to about 250 times per minute, or more. It will further be appreciated that, in accordance with one non-limiting example embodiment, the spray guns 212,214 can accelerate from 0 rpm to about 500 rpm, and then rotate at the aforementioned constant predetermined rotational velocity, which is about 500 rpm. The spray guns 212,214, then decelerate from about 500 rpm to 0 rpm. Accordingly, it will be appreciated that an additional benefit of the disclosed concept is that the spray head 200 and, in particular the spray guns 212,214, operate (e.g., move; rotate) at a relatively slower speed (e.g., without limitation, 500 rpm) as compared to known spray head designs, wherein the single spray gun typically operates (e.g., rotate) at about 1,000 rpm. Among other benefits, this enables the coating to be accurately and efficiently applied to the area of the can end 400 desired, with little waste (e.g., without limitation, minimal overspray). It also provides for additional time for the spray guns 212,214 to provide a thorough and complete repair coating to the can ends 400 and, in particular the score lines 402 thereof.

Figure 3:
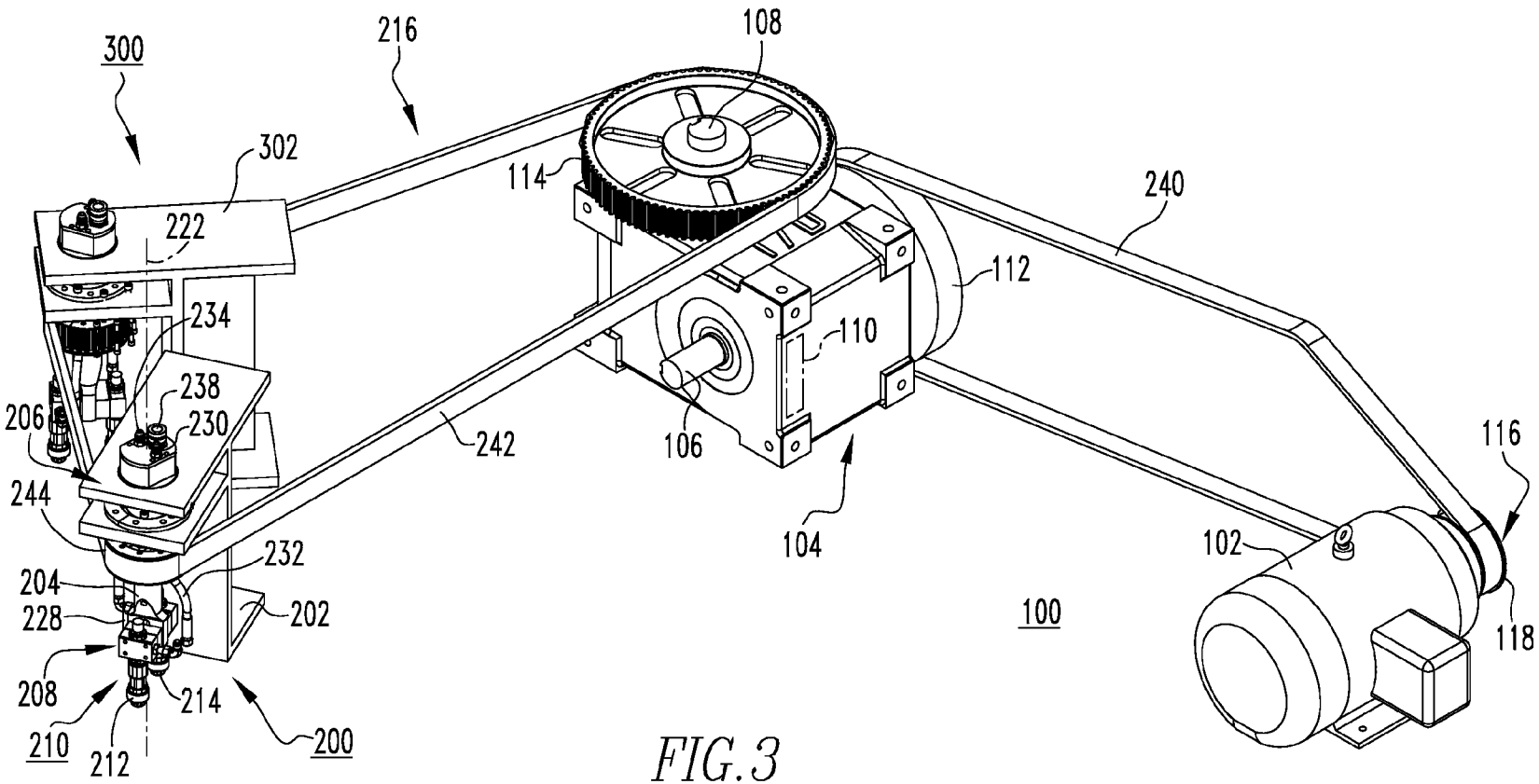
FIG. 3 is an isometric view of the spray assembly and spray heads therefor of FIG. 2.

Continuing to refer to FIG. 4, motion of the spray guns 212,214 will also be appreciated with reference to the change in position about the central longitudinal axis of rotation 222 of the pivotal shaft 204 (FIGS. 1 and 3) of the spray head 200 (FIGS. 1-3). Specifically, as shown in FIG. 4, and referring in particular to the first spray gun 212 (also designated as spray gun "1" in schematic form in FIG. 4), motion of the spray gun 212 during the spray cycle can be further described as follows. For example and without limitation, if the spray cycle begins with the spray gun 212 at 0 degrees with respect to the central axis 222, then the spray gun 212, in accordance with one non-limiting embodiment of the disclosed concept, accelerates in the first direction (e.g., counterclockwise in the direction of arrow 600 from the perspective of FIG. 4) from about 0 degrees to about 45 degrees with respect to the central axis 222, as shown in the first sequential step of FIG. 4. As shown in the next step, from about 45 degrees to about 225 degrees the spray gun 212 rotates in the first direction 600 at the constant predetermined rotational velocity (e.g., without limitation, about 500 rpm). Then, from about 225 degrees to about 270 degrees the spray gun 212 decelerates, with the spray gun 212 stopping at about 270 degrees. The motion then reverses, with the spray gun 212 accelerating in the second, reverse direction (e.g., clockwise in the direction of arrow 700 from the perspective of FIG. 4) from about 270 degrees to about 225 degrees. Once the spray gun 212 has reached the desired predetermined rotational velocity (e.g., without limitation, about 500 rpm) the spray gun 212 will rotate at constant velocity from about 225 degrees to about 45 degrees. Finally, from about 45 degrees to 0 degrees the spray gun 212 decelerates, coming to a complete stop at about 0 degrees to end the spray cycle. It will be appreciated that the second spray gun 214 (also designated as spray gun "2" in schematic form in FIG. 4) is offset from the first spray gun 212 in an opposite direction, such that motion of the second spray gun 214 is essentially the same as the first spray gun 212, but offset by 180 degrees with respect to the central longitudinal axis of rotation 222. It will, however, be appreciated that the foregoing is one non-limiting example embodiment in accordance with the disclosed concept. Different spray head arrangements having a different number, type and/or configuration of spray guns (not shown) could be employed, without departing from the scope of the disclosed concept, in which event the speed, angles and/or oscillating motion(s) would all be suitably adjusted to accommodate the new configuration, as necessary.

The spray assembly 100 will now be further described in connection with FIGS. 2 and 3. Specifically, in the example shown and described herein, the motion control mechanism is a cam box 104. The cam box 104 includes an input shaft 106, an output shaft 108, and a number of cams 110 (one cam is shown in simplified form in phantom line drawing in FIG. 3). The power source is an electric motor 102, wherein the motor 102 moves the input shaft 106 of the cam box 104, thereby moving the cams 110 to induce the aforementioned predetermined motion (e.g., without limitation, oscillating motion) of the output shaft 108. The oscillating motion of the output shaft 108 is then transferred by the transfer mechanism 216, which in the example shown and described herein is a number of timing belts 240,212, to the pivot member 204 of the spray head 200 (as well as spray head 300 and any additional or alternative number and/or configuration of spray heads (not shown)). In this manner, the predetermined oscillating motion is transferred to the spray guns 212,214 (FIG. 3), as previously described.

More specifically, the cam box 104 further includes an input gear 112 suitably coupled to the input shaft 106, and an output gear 114 suitably coupled to the output shaft 108. The electric motor 102 also includes a shaft 116 to which a motor gear 118 is suitably coupled. Accordingly, in the example of FIGS. 2 and 3, a first timing belt 240 mechanically connects the motor gear 118 to the input gear 112 of the cam box 104, such that movement of the motor shaft 116 and motor gear 118 drives the cam box 104 to induce the oscillating motion, of the cam box output shaft 108 and output gear 114. The second belt 242 transfers such oscillating motion from the cam box output shaft 108 to the pivotal shaft 204 of the spray head(s) 200 (see also spray head 300) by way of the output gear 114 of the cam box 104 and a transfer gear 244. The transfer gear is coupled to the pivotal shaft 204 of the spray head 200 (see also spray head 300), as best shown in FIG. 1. It will be appreciated that the belts 240,242 and gears 112, 118,114,244 can include a plurality of a corresponding grooves or recesses and protrusions or teeth, as shown, in order that the belts 240,242 do not slip with respect to the gears 112,114,118,244 and the transfer mechanism 216 effectively transfers the predetermined oscillating motion to the spray guns 212,214 in the desired manner previously discussed hereinabove.

It will be appreciated that the machine 2 and spray assembly 100 could be configured in a wide variety of alternative arrangements other than those which are shown and described herein, without departing from the scope of the disclosed concept. For example and without limitation, while the example spray assembly 100 includes two spray heads 200, 300 for spraying can ends 400,500 having different diameters 404,504, respectively, any known or suitable alternative number, type and/or configuration of spray heads (not shown) could be employed to spray (e.g., coat; repair) a wide variety of different can ends having the same or different sizes and/or shapes.

By way of example, and without limitation, the machine 2 (shown in simplified form in phantom line drawing) of FIG. 2 includes a first lane 4 and a second lane 6. A first plurality of can ends 400 is transported by the first lane 4 from a can end supply mechanism such as, for example and without limitation, a down stacker 8 (shown in simplified form in phantom line drawing in FIG. 2) to the first spray head 200. A second plurality of can ends 500 is transported by the second lane 6 from a suitable can end supply mechanism such as, for example and without limitation, the down stacker 10 (shown in simplified form in phantom line drawing in FIG. 2) to the second spray head 300. Thus, in accordance with the example non-limiting embodiment of FIG. 2, can ends 400,500 having different diameters 404,504, respectively, can be relatively quickly and easily coated (e.g., without limitation, repaired) within the same spray assembly 100.

It will be appreciated, therefore, that the disclosed spray assembly 100 and spray heads (e.g., without limitation, 200, 300) can be set up in a wide variety of configurations, for example and without limitation, for use with a plurality of different lanes (e.g., without limitation, first lane 4, second lane 6) wherein each lane may contain can ends (e.g., without limitation, can ends 400; can ends 500) having any known or suitable diameter (e.g., without limitation, diameter 404; diameter 504) or shape. Additionally, the spray heads (e.g., without limitation, 200,300) themselves can be relatively quickly and easily configured and/or reconfigured, for example and without limitation, by employing a different number and/or configuration of spacers 224,226 (best shown in FIG. 1) or removing a number of spacers 224,226 (FIG. 1), by attaching a different number, type and/or configuration of spray guns (e.g., without limitation, spray guns 212,214 of FIG. 1), by connecting a different coating or other suitable fluid supply and/or different electrical connector (e.g., without limitation, electrical connector 236 partially shown in FIG. 1), and/or by adjusting or changing one or more of the components (e.g., without limitation, motor 102; cam box 104) of the spray assembly 100, in order to adjust or change the desired predetermined motion that is imparted to the spray guns 212,214.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A spray assembly for a machine structured to apply a coating to a plurality of can ends, the spray assembly comprising:

a power source;

a motion control mechanism; and at least one spray head comprising:

a mounting member, a pivot member including a first end movably coupled to the mounting member, and a second end disposed opposite and distal from the first end, a gun assembly comprising a plurality of spray guns coupled to the pivot member proximate the second end, and a transfer mechanism for transferring a predetermined motion that is induced by the motion control mechanism from the motion control mechanism to the pivot member, wherein each of the spray guns is structured to apply the coating to the can ends in accordance with said predetermined motion; wherein the pivot member is a pivotal shaft; wherein the pivotal shaft has a longitudinal axis of rotation; wherein the second end of the pivotal shaft includes a first mounting portion and a second mounting portion disposed opposite the first mounting portion; wherein said plurality of spray guns is a first spray gun coupled to the first mounting portion and a second spray gun coupled to the second mounting portion; wherein the gun assembly further comprises a number of spacers; wherein each of the spacers is disposed between one of the first and second mounting portions and a corresponding one of the first and second spray guns, thereby offsetting said spray gun with respect to the longitudinal axis of rotation; wherein each of the first and second spray guns is structured to move in an arcuate path to coat a corresponding arcuate portion of the can ends; wherein each of the can ends has a diameter; and wherein the spacers are structured to adjust the size of the arcuate spray path of the spray guns to correspond to the diameter of the can ends.

2. The spray assembly of claim 1 wherein said predetermined motion is an oscillating motion comprising the following sequential steps:

(a) an acceleration of the spray guns in a first direction to begin a spray cycle;

(b) rotation of the spray guns at a constant predetermined rotational velocity in the first direction as a first can end is sprayed;

(c) deceleration of the spray guns in the first direction to a complete stop;

(d) acceleration of the spray guns in a second, reverse direction;

(e) rotation of the spray guns at a constant predetermined rotational velocity in the second direction as a second different can end is sprayed; and (f) deceleration of the spray guns in the second direction to a complete stop, thereby ending the spray cycle.

3. The spray assembly of claim 1 wherein the motion control mechanism is a cam box; wherein the cam box includes an input shaft, an output shaft, and a number of cams; wherein the power source is a motor; wherein the motor moves the input shaft, thereby moving the cams to induce said predetermined motion as an oscillating motion of the output shaft; wherein the transfer mechanism is a number of belts; and wherein the belts transfer the oscillating motion to the pivot member, thereby oscillating the spray guns.

4. A spray assembly for a machine structured to apply a coating to a plurality of can ends, the spray assembly comprising:

a power source;

a motion control mechanism; and at least one spray head compromising:

a mounting member, a pivot member including a first end movably coupled to the mounting member, and a second end disposed opposite and distal from the first end, a gun assembly comprising a plurality of spray guns coupled to the pivot member proximate the second end, and a transfer mechanism for transferring a predetermined motion that is induced by the motion control mechanism from the motion control mechanism to the pivot member, wherein each of the spray guns is structured to apply the coating to the can ends in accordance with said predetermined motion; wherein the motion control mechanism is a cam box; wherein the cam box includes an input shaft, an output shaft, and a number of cams; wherein the power source is a motor; wherein the motor moves the input shaft, thereby moving the cams to induce said predetermined motion as an oscillating motion of the output shaft: wherein the transfer mechanism is a number of belts; and wherein the belts transfer the oscillating motion to the pivot member, thereby oscillating the spray guns; wherein said at least one spray head is a plurality of spray heads; wherein the machine includes a plurality of lanes each delivering a plurality of can ends to a corresponding one of the spray heads; and wherein the mounting member of each spray head is structured to be coupled to the machine proximate to a corresponding one of the lanes.

5. A machine comprising:

at least one lane transporting a plurality of can ends; and a spray assembly for applying a coating to the can ends, the spray assembly comprising:

at least one spray head comprising:

a power source, a motion control mechanism, and at least one spray head comprising:

a mounting member coupled to the machine proximate to a corresponding one of said at least one lane, a pivot member including a first end movably coupled to the mounting member, and a second end disposed opposite and distal from the first end, a gun assembly comprising a plurality of spray guns coupled to the pivot member proximate the second end, and a transfer mechanism for transferring a predetermined motion that is induced by the motion control mechanism from the motion control mechanism to the pivot member, wherein each of the spray guns applies the coating to the can ends in accordance with said predetermined motion; wherein the at least one spray head is a plurality of spray heads; and wherein said at least one lane of the machine is a plurality of lanes each delivering a plurality of can ends to a corresponding one of the spray heads.

6. The machine of claim 5 wherein the pivot member is a pivotal shaft; wherein the pivotal shaft has a longitudinal axis of rotation; wherein the second end of the pivotal shaft includes a first mounting portion and a second mounting portion disposed opposite the first mounting portion; wherein said plurality of spray guns is a first spray gun coupled to the first mounting portion and a second spray gun coupled to the second mounting portion; wherein the gun assembly further comprises a number of spacers; and wherein each of the spacers is disposed between one of the first and second mounting portions and a corresponding one of the first and second spray guns, thereby offsetting said spray gun with respect to the longitudinal axis of rotation.

7. The machine of claim 5 wherein said predetermined motion is an oscillating motion comprising the following sequential steps:

(a) an acceleration of the spray guns in a first direction to begin a spray cycle;

(b) rotation of the spray guns at a constant predetermined rotational velocity in the first direction as a first can end is sprayed;

(c) deceleration of the spray guns in the first direction to a complete stop;

(d) acceleration of the spray guns in a second, reverse direction;

(e) rotation of the spray guns at a constant predetermined rotational velocity in the second direction as a second different can end is sprayed; and (f) deceleration of the spray guns in the second direction to a complete stop, thereby ending the spray cycle.

8. The machine of claim 5 wherein the motion control mechanism is a cam box; wherein the cam box includes an input shaft, an output shaft, and a number of cams; wherein the power source is a motor; wherein the motor moves the input shaft, thereby moving the cams to induce said predetermined motion as an oscillating motion of the output shaft; wherein the transfer mechanism is a number of belts; and wherein the belts transfer the oscillating motion to the pivot member of each spray head, thereby oscillating the spray guns of the spray head.

9. The machine of claim 5 wherein said plurality of spray heads is a first spray head and a second spray head; wherein said plurality of lanes is a first lane and a second lane; wherein said plurality of can ends includes a first plurality of can ends being transported by the first lane to the first spray head, and a second plurality of can ends being transported by the second lane to the second spray head; wherein the first plurality of can ends has a first diameter; and wherein the second plurality of can ends has a second diameter different from the first diameter.

* * * * *